United States Patent [19]

Foster et al.

[11] 4,269,634

[45] May 26, 1981

[54] LOSS REDUCTION IN ORIENTED IRON-BASE ALLOYS CONTAINING SULFUR

[75] Inventors: Karl Foster, Forest Hills Boro; Jack W. Shilling, Murrysville Boro, both of Pa.

[73] Assignee: Westinghouse Electric Corp., Pittsburgh, Pa.

[21] Appl. No.: 100,089

[22] Filed: Dec. 4, 1979

[51] Int. Cl.[3] ..... H01F 1/00

[52] U.S. Cl. ..... 148/120; 148/113; 148/31.5

[58] Field of Search ..... 148/113, 122, 31.5

[56] References Cited

U.S. PATENT DOCUMENTS

| | | | |
|---|---|---|---|
| 3,278,348 | 10/1966 | Foster et al. | 148/110 |
| 3,528,863 | 9/1970 | Foster et al. | 148/113 |
| 3,833,431 | 9/1974 | Foster | 148/113 |
| 3,849,212 | 11/1974 | Thornburg | 148/31.55 |
| 3,881,967 | 5/1975 | Cochardt et al. | 148/31.55 |
| 3,892,605 | 7/1975 | Thornburg | 148/120 |
| 3,948,786 | 4/1976 | Evans | 148/113 |
| 3,985,583 | 10/1976 | Shimanaka et al. | 148/113 |
| 4,032,366 | 6/1977 | Choby | 148/31.5 |

*Primary Examiner*—L. Dewayne Rutledge
*Assistant Examiner*—John P. Sheehan
*Attorney, Agent, or Firm*—R. A. Stoltz

[57] ABSTRACT

This is a method for making a low alloy iron having desirable magnetic characteristics suitable for electrical applications such as transformer cores. The ingot alloy has a relatively high (more than 50 ppm) sulfur and relatively high manganese (0.01–0.15%) and thus can be prepared from commercially available materials without further purification. While the sulfur in such a manganese containing alloy is not removed during final annealing (due to generally less than about 950° C. final annealing temperatures of the primary recrystallization process) the use of a tensile stress (at least 200 psi) inducing glass coating provides for very low losses. The material contains significant amounts of both sulfur and manganese. Both the sulfur and manganese contribute towards the meltability of the alloy and the manganese contributes towards the workability (especially for cool rolling) of the sulfur containing material. Thus the material containing manganese and sulfur, has the high permeability of a low silicon primarily recrystallized material, but does not have the high losses normally associated with a relatively high sulfur containing magnetic material.

5 Claims, No Drawings

LOSS REDUCTION IN ORIENTED IRON-BASE ALLOYS CONTAINING SULFUR

CROSS-REFERENCE TO RELATED APPLICATIONS

An oriented, primary recrystallized low-alloy iron with high initial sulfur content is described in related application Ser. No. 38,359, assigned to the same assignee. This related application utilizes an ingot which has high sulfur levels (0.012–0.020%) and is substantially free of manganese. Such higher sulfur contents reduce metal costs, but require a more extensive final anneal.

An oriented, primary recrystallized low-alloy iron with certain narrow ranges of silicon and chromium is described in related application Ser. No. 38,361, assigned to the same assignee. An additional related application which may be (but need not necessarily be) practiced with the above invention is described in related application Ser. No. 38,360, assigned to the same assignee. This related application is of a processing method and intermediate product alloy for oriented, primary recrystallized low-alloy iron and has critical levels of sulfur oxygen and carbon, but can contain relatively broad ranges of silicon and chromium.

BACKGROUND OF THE INVENTION

This invention relates to an iron-base alloy which, when processed in accordance with the method set forth herein, will produce an oriented grain structure in the finished product which is characterized by a cube-on-edge orientation, described in Miller Indicies as (110) [001] grain orientation, and having a primary recrystallized grain growth microstructure. Such magnetic materials are useful, for example, as core materials in power and distribution transformers.

The operating inductions of a large portion of todays transformers are limited by the saturation value of the magnetic sheet material which forms the core. In extensive use today is an iron-based alloy containing nominally 3.25% silicon (all composition percentages herein are in weight percent) which is processed in order to obtain cube-on-edge grain orientation in final product. A well-known example of this type of steel is called type M-5. These 3.25% silicon steels have the final grain orientation developed by means of a secondary recrystallized microstructure. This microstructure is obtained during the final box annealing in which preferentially oriented grains grow at the expense of non-preferentially oriented grains with the result that the alloy has an extremely large grain microstructure in which the diameter usually greatly exceeds the thickness of the sheet material. Obtaining such large grains in secondarily recrystallized microstructure requires a long time, high temperature anneal for the development of the orientation. An extensive anneal is generally also required for reduction of residual sulfur content. Sulfur contents in excess of about 100 ppm in the finished product have, in the past, adversely affected the magnetic characteristics exhibited by the silicon-iron alloy.

U.S. Pat. No. 3,833,431, issued on Sept. 3, 1974, to the inventors herein, describes a process for producing silicon steel containing nominally 3.25% silicon, by a continuous annealing process (a similar coating technique is shown in U.S. Pat. No. 3,278,348 to Foster and Seidel). The magnetic characteristics exhibited by the fully processed steel approach those of commercially available silicon steel, but without the necessity of extensively desulfurizing the steel from the sulfur content which is usually obtained by employing a commercial process. The process uses a relatively short anneal at about 1000°–1100° C. in order to substantially completely recrystallize the steel by a secondary recrystallization process (but which does essentially no desulfurization) and the application of a tensile stress of at least 200 psi to the steel for producing improved watt losses by, for example, applying glass to the surface of the steel sheet at an intermediate temperature (e.g. 700°–850° C.) such that the glass (which has a coefficient of thermal expansion substantially less than that of the steel) will, when cooled to room temperature, place the steel in tension.

The addition of the 3.25% silicon to iron, while effective and generally desirable for improving the volume resistivity, nevertheless lowers the saturation value in most commercially-produced iron alloys to generally less than about 20,300 gauss. Thus, there is a trade-off as the improved resistivity (which lowers core losses of the material) is obtained at the expense of saturation value (significantly lower than the saturation value of about 21,500 gauss of commercially pure iron). Moreover, since commercial iron has substantially higher core losses and substantially higher coercive force values than silicon steel, it was generally purdent to balance the overall magnetic characteristics and the best balance heretofore obtained was that of the 3.25% silicon iron alloy which exhibited the cube-on-edge orientation.

An alternative to the generally used commercial alloy is described in U.S. Pat. No. 3,849,212, issued Nov. 19, 1974, and the associated primary recrystallization method of U.S. Pat. No. 3,892,605, issued on July 1, 1975, (both to Thornburg) which relate to an iron-base alloy made from an ingot containing up to about 0.03% carbon, up to 1% manganese, from about 0.3 to about 4% of at least one of the volume resistivity improving elements selected from the group consisting of up to about 2% silicon, up to about 2% chromium, and up to about 3% cobalt (alloys with 4–6% cobalt are discussed in U.S. Pat. No. 3,881,967 to Cochardt and Foster), with the balance of the alloy being essentially iron with incidental impurities. Thornburg's method utilizes processing by hot working and either a two or three stage cold rolling operation with the final cold rolling stage working affecting only a moderate (50–75%) reduction in the cross-sectional area of the material being processed.

SUMMARY OF THE INVENTION

The present invention relates to a method for making a primary recrystallized, low-alloy iron (containing less than 2% silicon) but containing commercial levels (50–250 ppm and generally 70–150 ppm) of sulfur. While such sulfur levels would normally result in high $H_C$ and high losses, it has been found that tensile stress can be used to decrease the losses and that the losses in stressed alloys containing more than 50 ppm of sulfur can be reduced to the same values obtained in unstressed alloys in which the sulfur has been essentially completely removed. Preferably the material is stressed using glass coating.

DESCRIPTION OF THE PREFERRED EMBODIMENTS

The aforementioned U.S. Pat. No. 3,849,212 describes strong (110)[001] textures in iron-based alloys with a variety of silicon and chromium levels, and a broad range of manganese content and with the sulfur content held as low practicable (hot-band measurements cited in that patent indicated alloys with 0.0032% and with 0.0024% of sulfur). In the past, recommended sulfur levels for primary recrystallized alloys were generally about 50 ppm or less, as higher sulfur contents (e.g. 70–150 ppm) tended to degrade texture formation during processing, and residual sulfur, which was not removed during the relatively low annealing temperatures used for primary recrystallized alloys (about 900° C.) resulted in high coercive force and core loss values. Maintaining such low sulfur levels presented a problem, however, both because melting costs are higher for low sulfur iron and because commercially available iron normally contains above 100 ppm of sulfur and de-sulfurizing the commercially available iron is expensive. Thus unlike secondary recrystallized processes (where sulfur in the form of manganese sulfide is beneficial during processing) in these primary recrystallization processes, sulfur is present only as an impurity and is relatively expensive to remove. As noted previously, there is no significant sulfur removal in the final anneal of a primary recrystallization process (especially at less than about 950° C. in alloys containing at least the normally impurity levels of manganese).

A series of tests were performed which showed that (at least 200 psi of) applied tension could reduce the losses in primarily recrystallized iron-base alloys having commercial impurity levels of sulfur (generally greater than 50 ppm). In one series of tests, four alloys were investigated, with nominal melt compositions as shown in Table 1 below.

TABLE 1

| Alloy | % Si | % Cr | % Co | % Mn | % S |
|---|---|---|---|---|---|
| SB47 | 1.5 | 0 | 4.0 | 0.15 | 0.005 |
| SB50 | 1.5 | 0.15 | 4.0 | 0.05 | 0 |
| SB73 | 1.2 | 1.2 | 0 | 0.15 | 0.005 |
| SB80 | 0.3 | 0.3 | 0 | 0 | 0.015 |

Alloys SB 47 and SB 50 were rolled in two stages to a final thickness of 9 mils and alloys SB 73 and SB 80 were rolled in three stages to a final thickness of 6 mils. Epstein samples were annealed for 48 hours at 900° C. for texture development. The results of magnetic testing for alloys SB 47 and SB 50 are given in Table 2 below and show the effect of tension on the magnetic properties. The measurements include $H_C$ (coercive force in Oersteds), $B_r$ in kilogauss, $B_{10}$ values in kilogauss (induction in a 10 Oersted field) and $P_C$ values in W/lb (core loss at 60 hertz in watts per pound) at 15, 17 and 18 kilogauss.

TABLE 2

| Alloy | Tension (psi) | $H_c$ (Oe) | $B_r$ (kG) | $B_{10}$ (kG) | $P_{c15/60}$ (W/lb) | $P_{c17/60}$ (W/lb) | $P_{c18/60}$ (W/lb) |
|---|---|---|---|---|---|---|---|
| SB47 | 0 | 0.210 | 16.7 | 19.4 | 0.63 | 0.83 | 0.98 |
| SB47 | 500 | 0.187 | 17.0 | 19.4 | 0.57 | 0.76 | 0.90 |
| SB47 | 1000 | 0.184 | 15.9 | 19.4 | 0.57 | 0.75 | 0.88 |
| SB47 | 1500 | 0.187 | 14.7 | 19.4 | 0.58 | 0.76 | 0.88 |
| SB50 | 0 | 0.141 | 16.5 | 19.1 | 0.55 | 0.75 | 0.92 |
| SB50 | 500 | 0.131 | 14.5 | 19.1 | 0.54 | 0.76 | 0.91 |
| SB50 | 1000 | 0.132 | 12.7 | 19.1 | 0.55 | 0.76 | 0.91 |

TABLE 2-continued

| Alloy | Tension (psi) | $H_c$ (Oe) | $B_r$ (kG) | $B_{10}$ (kG) | $P_{c15/60}$ (W/lb) | $P_{c17/60}$ (W/lb) | $P_{c18/60}$ (W/lb) |
|---|---|---|---|---|---|---|---|
| SB50 | 1500 | 0.137 | 10.9 | 19.1 | 0.57 | 0.77 | 0.91 |

Even though it had a somewhat higher $B_{10}$ value, sample SB 47 had a substantially higher $H_C$ and losses than SB 50 when no tension was applied, due to the higher sulfur content in SB 47. It can be seen, however, that application of 500 psi tension to (sulfur containing) alloy SB 47 reduced the losses to values similar to the values obtained for SB 50 (which contains essentially no sulfur). It can also be seen that further increases in tension on alloy SB 47 had little further affect on losses and that application of tension to the essentially zero sulfur containing alloy SB 50 had no significant affect on the losses.

The results of testing of alloys SB 73 and SB 80 are given in Table 3 below.

TABLE 3

| Alloy | Tension (psi) | $H_c$ (Oe) | $B_r$ (kG) | $B_{10}$ (kG) | $P_{c15/60}$ (W/lb) | $P_{c17/60}$ (W/lb) | $P_{c18/60}$ (W/lb) |
|---|---|---|---|---|---|---|---|
| SB73 | 0 | 0.178 | 17.8 | 19.3 | 0.55 | 0.69 | 0.85 |
| SB73 | 400 | 0.164 | 17.4 | 19.4 | 0.47 | 0.62 | 0.78 |
| SB73 | 750 | 0.161 | 16.6 | 19.4 | 0.44 | 0.59 | 0.73 |
| SB73 | 1100 | 0.160 | 16.5 | 19.4 | 0.43 | 0.58 | 0.70 |
| SB80 | 0 | 0.140 | 17.5 | 19.9 | 0.63 | 0.78 | 0.89 |
| SB80 | 400 | 0.136 | 17.1 | 19.9 | 0.57 | 0.74 | 0.88 |
| SB80 | 750 | 0.135 | 16.9 | 19.9 | 0.54 | 0.71 | 0.85 |
| SB80 | 1100 | 0.134 | 16.7 | 19.9 | 0.52 | 0.70 | 0.83 |

Because it had no manganese addition, alloy SB 80 underwent significant sulfur removal (to less than 0.005%) during the 48 hour anneal at 900° C. and the $H_C$ value for alloy SB 80 is lower than that obtained for alloy SB 73. Still, it can be seen that the losses at zero tension for alloy SB 73 are lower because of its higher alloy content and resistivity. Alloy SB 73 exhibited a significant reduction in loss with 400 psi tension. The application of even higher tensions provided some additional reduction in losses. It can be seen that alloy SB 80 losses (which are due to its lower alloy content and resistivity, rather than its sulfur content) shows much less improvement with applied tension. Thus it can be seen that the use of tension allows commercial levels of sulfur to be used together with resistivity improving elements (and especially together with manganese) in a process which uses the low temperature (less than about 900° C.) final annealing for primary recrystallized material.

Tests performed using glass coatings to apply the tensile stress generally also gave reduced losses at both 15 and 17 k.G. It is felt, however, that the above tests using direct tension provide the best indication of the benefits of this technique.

Thus ingot alloys can be prepared with less than 2% silicon, up to 2% chromium, up to 6% cobalt, commercial levels of sulfur (more than 50 ppm) and 0.02–0.15% manganese, the remainder being iron with incidental impurities. The ingot is hot worked, cold worked in one or more operations to a final thickness and final anneal (typically for 24–72 hours) at 800°–950° C. The composition of the alloy is essentially unchanged during this processing except that the carbon content will fall to less than 0.005%.

The material is tensioned by a glass applied to the surface of the magnetic material in a manner similar to that described in the aforementioned U.S. Pat. No. 3,833,431.

A slurry of glass is applied to the surfaces of the primary recrystallized iron-based alloy. The glass has a coefficient of thermal expansion substantially less than that exhibited by the underlining iron and usually of the order of less than about $8.5\times10^{-6}$ inch per inch per degree centigrade. By applying a proper thickness of the slurry of glass to both of the surfaces of the iron sheet or strip and fusing the glass at an intermediate temperature, for example 700°–800° C., the iron upon cooling to room temperature will be placed in tension (preferably within the range of about 400–2000 psi). As can be seen from the above-mentioned test results, 400 psi tensions produce significant improvements in losses, higher stresses than about 2000 psi give little appreciable further improvement.

Alternate methods can, of course, be used to apply the glass coatings. Examples of such alternate method are shown, for example, in U.S. Pat. Nos. 3,948,786; 4,032,366; 3,856,568; and 3,985,583.

In order to provide for proper stacking factor, (when the material is ultimately used, for example, in the lamination of a power transformer core) the glass generally should range between about 0.05 mil and about 0.30 mil in thickness. The thinner coatings (e.g. 0.05 mils) should generally be used on relatively thin (e.g. 6 mil) sheet.

One satisfactory glass has a composition of about 8% $SiO_2$, 20% $B_2O_3$, 60% ZnO and 12% PbO exhibited a coefficient of thermal expansion of about $4.6\times10^{-6}$ per degree centigrade and can be fired at a temperature of 760° C. Glasses having coefficient of thermal expansion of less than $8.5\times10^{-6}$ inch per inch per degree centigrade and having a firing temperature of generally less than about the final annealing temperature (e.g. less than 900° C.) can generally be used.

From the foregoing, it can be seen that the process of the present invention is effective for use with oriented primary recrystallized iron and eliminates the necessity of substantially completely desulfurizing the ingot material. Such a process is effective even when the material contains volume resistivity improving elements and in particular when the material contains manganese impurities in commercial levels.

This invention is not to be construed as limited to the particular forms described herein, since these are to be regarded as illustrative rather than restrictive. The invention is intended to cover all methods which do not depart from the spirit and scope of the invention.

What we claim is:

1. In a process for producing primary recrystallized iron having a cube-on-edge orientation of the type of which utilizes preparing an ingot alloy, hot working said alloy, working said alloy to final thickness, and final annealing at a temperature between about 800° and 950° C., the improvement which comprises:

(a) preparing an ingot alloy consisting essentially of 0.01–0.15% manganese, more than 50 ppm but less than about 250 ppm sulfur, 0.1–2.0% silicon, up to 2% chromium, up to 6% cobalt, up to 0.03% carbon, with the remainder being iron and incidental impurities;

(b) fusing on the surface of the final annealed alloy a coating of glass having a coefficient of thermal expansion of less than about $8.5\times10^{-6}$ inches per inch per degree centigrade to affect a tensile stress on the material at least 200 psi by heating to a temperature of at least 700° C., but less than the temperature at which said alloy was final annealed.

2. The process of claim 1, wherein said glass coating has a thickness of 0.05–0.30 mils.

3. The process of claim 1, wherein the tensile stress is 400–2000 psi.

4. The process of claim 3, wherein said ingot alloy contains 70–150 ppm of sulfur.

5. A grain oriented primary recrystallized iron alloy with a tensile stress inducing glass coating, said coated alloy being useful for magnetic applications, said coated alloy comprising:

(a) an alloy consisting essentially of 0.01–0.15% manganese, 50–250 ppm sulfur, 0.1–2.0% silicon, up to 2% chromium, up to 6% cobalt, up to 0.005% carbon, with the remainder being iron; and (b) a 0.05–0.30 mil thick glass coating on the surface of said alloy, said glass coating having a coefficient of thermal expansion of less than $8.5\times10^{-6}$ inches per inch per degree centigrade.

* * * * *